United States Patent [19]

Leigh

[11] 4,398,467

[45] Aug. 16, 1983

[54] EXPLOSIVE FRAGMENTATION DEVICES WITH COILED WIRE PROGRESSIVELY VARIED

[75] Inventor: John W. Leigh, Sale, England

[73] Assignee: The Secretary of State for Defence in Her Britannic Majesty's Government of the United Kingdom of Great Britain and Northern Ireland, London, England

[21] Appl. No.: 213,755

[22] Filed: Dec. 5, 1980

[30] Foreign Application Priority Data

Dec. 13, 1979 [GB] United Kingdom ..... 7943069

[51] Int. Cl.[3] ..... F42B 13/18

[52] U.S. Cl. ..... 102/491; 102/389; 102/475; 102/496; 102/506; 29/1.2

[58] Field of Search ..... 102/389, 475, 491, 492, 102/494, 496, 506; 29/1.2, 1.21, 1.22, 1.23, 1.3, 1.1, 1.11

[56] References Cited

U.S. PATENT DOCUMENTS

| | | | |
|---|---|---|---|
| 33,541 | 10/1861 | Pfund | 102/491 |
| 1,203,062 | 10/1916 | Semple | 102/389 |
| 2,337,765 | 12/1943 | Nahirney | 102/389 |
| 2,393,274 | 1/1946 | Whitesell, Jr. | 102/389 |
| 2,458,576 | 1/1949 | Etten | 102/389 |
| 3,298,308 | 1/1967 | Throner, Jr. | 102/496 |
| 3,349,711 | 10/1967 | Darigo et al. | 29/1.23 X |
| 3,590,451 | 7/1971 | Dessart | 29/1.21 |
| 3,757,693 | 9/1973 | Shea | 102/482 X |

FOREIGN PATENT DOCUMENTS

| | | |
|---|---|---|
| 2312009 | 5/1975 | France . |
| 580415 | 9/1946 | United Kingdom . |

*Primary Examiner*—Peter A. Nelson

*Attorney, Agent, or Firm*—Pollock, Vande Sande and Priddy

[57] ABSTRACT

An explosive fragmentation device such as a grenade or a mortar bomb has a casing formed from flat sided notched wire formed into a coil. Instead of coiling the wire so that sides of the coiled wire which are adjacent after coiling lie normal to the longitudinal axis of the coil, as in a known form of grenade body, the wire is given additionally a twist about its own longitudinal axis during coiling, so that the adjacent flat faces of adjacent turns are substantially normal to the surface of the finished casing. In this way adjacent turns overlay one another, preferably completely, and the outer surface of the casing can then be smooth. Also, adjacent turns can then be bonded together as by brazing or soldering, which is impractical with coiling "normal to the axis". This means explosive cannot be trapped between adjacent turns to be accidentally detonated, an outer casing is unnecessary, and the casing is stronger.

13 Claims, 7 Drawing Figures

EXPLOSIVE FRAGMENTATION DEVICES WITH COILED WIRE PROGRESSIVELY VARIED

This invention relates to explosive fragmentation devices, such as, for example, grenades, mortar bombs, shell bodies and guided missile warhead cases. Such devices generally comprise a mass of explosive within a metal casing, and are intended to explode an deployment so as to shatter the casing and send out fragments of the casing with high velocity. The object is to disable personnel, fighting vehicles or aircraft as the case may be, within a range which may be struck by the high velocity fragments.

In recent years it has been appreciated that for maximum effect the casing should shatter in a predetermined manner, generally so as to produce a large number of fragments of substantially equal size, rather than a few large fragments. In this way the probability of securing a hit can be very greatly increased. Also, for a grenade, it is important to ensure that the lethal range of the fragments is such as to disable personnel within a substantial range while leaving an unprotected thrower safely outside this range.

These objectives are met to a certain extent by a known form of grenade comprising a casing formed by coiling pre-notched wire of rectangular cross-section, the coils being of varying diameter and arranged to overlie adjacent coils so as to define an oval (i.e. prolate spheroid) shaped casing. In this known grenade the contacting surfaces of adjacent coils are arranged to lie normal to the axis of the casing so formed, giving the surface of the casing a stepped appearance. The coils are not fixed together other than by their own resilience, and accordingly it has been found necessary to provide a light outer casing of metal to prevent the ingress of moisture and the escape of explosive.

Because of the oval shape, the outer casing has had to be made in two parts joined at the section of maximum diameter.

The known grenade suffers from a number of design disadvantages. In particular, the method of coiling necessitates leaving relatively large apertures at the ends of the coil. It will be apparent also that the method results in a lesser surface density of notched wire towards the ends of the coil then in its mid region. These factors lead to a reduction in the number of fragments produced by a grenade of given size, and to unevenness in the fragment distribution pattern. The effectiveness of the grenade is hence reduced. In addition, the metal outer casing does not produce effective metal fragments, and hence the ratio of effective metal mass to explosive mass is reduced. Also the need for an outer casing to be ruptured and penetrated reduces the effectiveness of the wire fragments. Crevice corrosion can occur at the join in the outer casing, and further the whole structure is mechanically weaker, and hence less able to withstand rough handling by virtue of its construction from several separate components. A serious shortcoming of the design is the possibility of explosive material migrating into friction points between the coils, and between the coiled main casing and the outer casing—leading to a safety risk from accidental explosion.

Mortar bombs conventionally comprise a mass of explosive within a forged or cast metal casing which may be machined to final shape. The conventional design suffers from the great disadvantage that the distribution of fragments on detonation cannot be continued.

It depends upon the inherent weaknesses in the casing which cannot readily be predetermined, and accordingly an unduly wide spectrum of sizes, from several large fragments down to small dust size particles, form the distribution pattern. The probability of securing a considerable number of hits is thus greatly reduced as compared with the desired effect from an even distribution of relatively small but optimized size fragments. The present invention together with certain preferred aspects thereof seeks to mitigate or avoid at least some of the aforesaid shortcomings of the prior known explosive fragmentation devices.

According to the present invention there is provided a casing for an explosive fragmentation device, said casing being formed from wire having a pair of opposed flat faces, the wire being coiled so that the said opposed flat faces of adjacent turns overlay one another and are substantially normal to the surface of the casing, the surface of the casing being curved in the longitudinal direction of coiling.

Preferably the said opposed flat faces of adjacent turns overlay one another substantially completely.

Normally the said opposed flat faces of adjacent turns are bonded together.

A convenient method of bonding is soldering or brazing.

The wire will normally be formed with weakened sections at intervals along its length. Conveniently the weakened sections are in the form of notches extending transversely of the wire across a face other than the said opposed flat faces.

The wire can conveniently be of square or other rectangular cross-section.

The invention will now be described by way of example only with reference to the accompanying drawings, of which FIG. 1 is a side elevation of a broken-out length of wire suitable for forming a casing in accordance with the invention;

Figure 1:
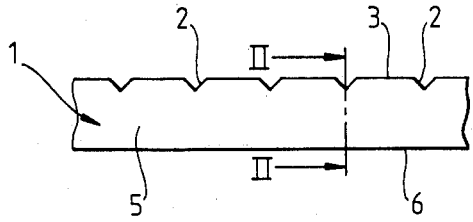
Figure 2:
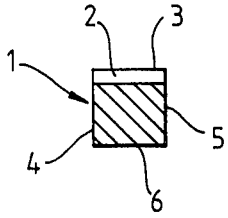
FIG. 2 is a sectional end elevation on the line II—II of FIG. 1.
Figure 4:
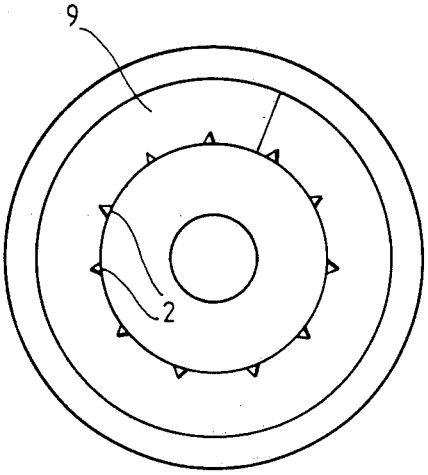
FIG. 4 is an elevation of the mortar bomb casing of FIG. 3 viewed in the direction of arrow IV.
Figure 5:
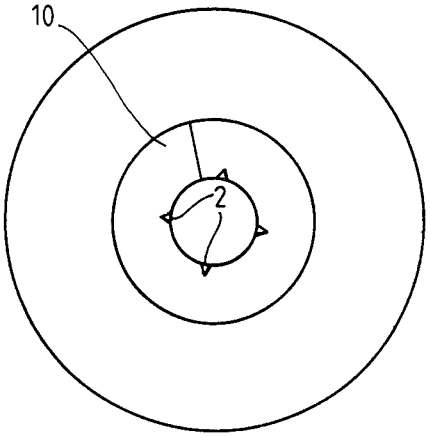
FIG. 5 is an elevation of the mortar bomb casing of FIG. 3 viewed in the direction of arrow V.
Figure 3:
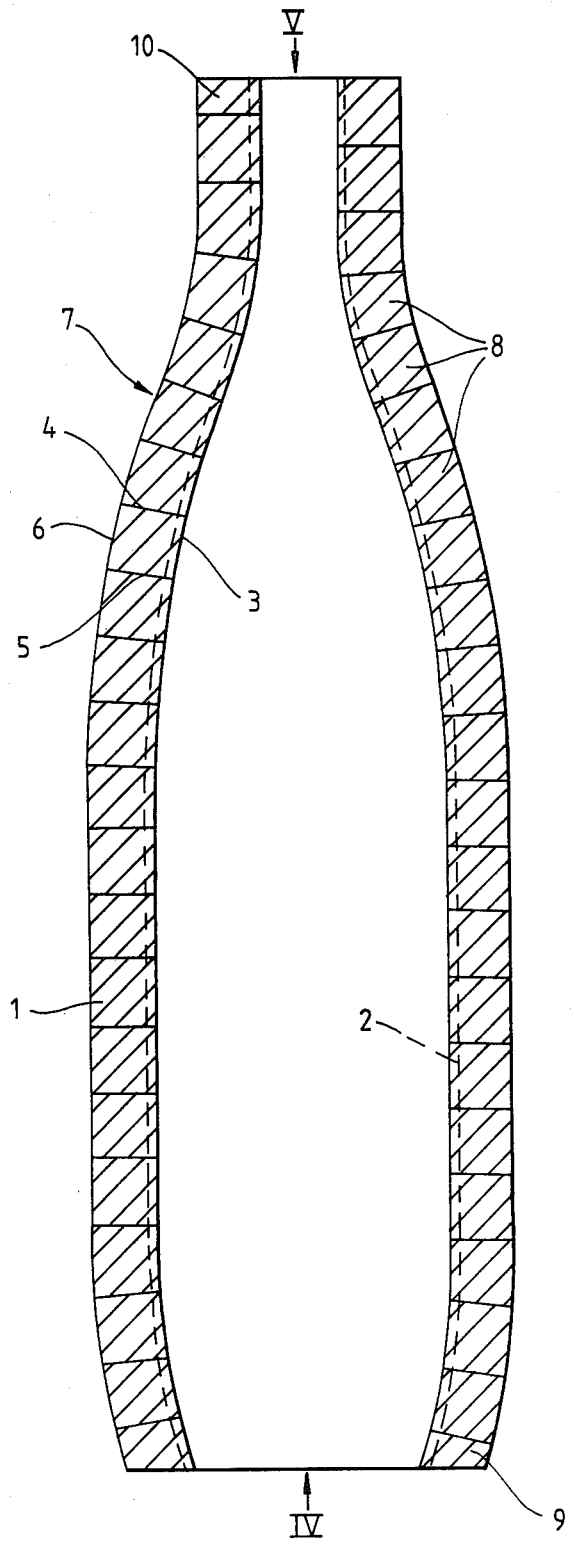
FIG. 3 is an axial section through a mortar bomb casing in accordance with the invention.

Referring to FIGS. 1 and 2, the length of wire 1 shown therein is of mild steel and of generally square cross-section, and has weakened sections in the form of notches 2 extending transversely across one face 3 of the wire at regular intervals along its entire length. The wire has a pair of opposed flat faces 4, 5 adjacent the notched face 3. The other two faces 3 and 6 are also flat, but this need not necessarily be so. Also faces 4 and 5 need not necessarily be parallel to each other prior to coiling, e.g. a trapezoidal shape may be chosen to counter the colastic effect so the faces 4 and 5 after coiling become approximately parallel. The mortar bomb casing 7 shown in FIGS. 3, 4 and 5 is formed from the notched wire stock shown in FIGS. 1 and 2. The casing 7 is in the form of a single coil having a number of turns 8 formed from a single length of the wire stock 1. The coil is wound such that the notches 2 all lie on the inner surface thereof.

The casing is given an outer surface which is curved in the longitudinal direction of coiling by varying the diameter of the turns 8 progressively along the axis of the coil so as to provide the desired overall form. By applying an appropriate twist about the longitudinal axis of the wire as well as coiling about a longitudinal coiling axis it is arranged that the flat faces 4, 5 of adjacent turns 8 lay substantially normal to the surface of the casing. This means that flat faces 4, 5 of adjacent turns can overlay one another substantially completely.

The adjacent turns 8 are bonded together by their faces 4, 5. This is achieved in the preferred method by first copper-plating the wire after coiling—e.g. in a chemical bath or electrolytically. The copper-plated coil is then brazed—e.g. in a vacuum furnace or an induction furnace to fuse the copper coatings of adjacent turns together along the adjacent faces 4, 5. Other possible methods of bonding will be apparent to the skilled reader-e.g. electric resistance welding, fusion welding and soldering, etc.

After brazing, the end faces of the end turns 9, 10 are machined flat. Some further machining on the outside surface is normally necessary before the casing is ready for use, but this is minimized because the method of coiling provides a relatively smooth outer surface which can be near to final shape. Further machining can be limited to that necessary for attachment of a nose gap and fuzing means at the end 9, a tail cap and fins at the end 10, and the provision of a groove for a driving band.

Figure 6:
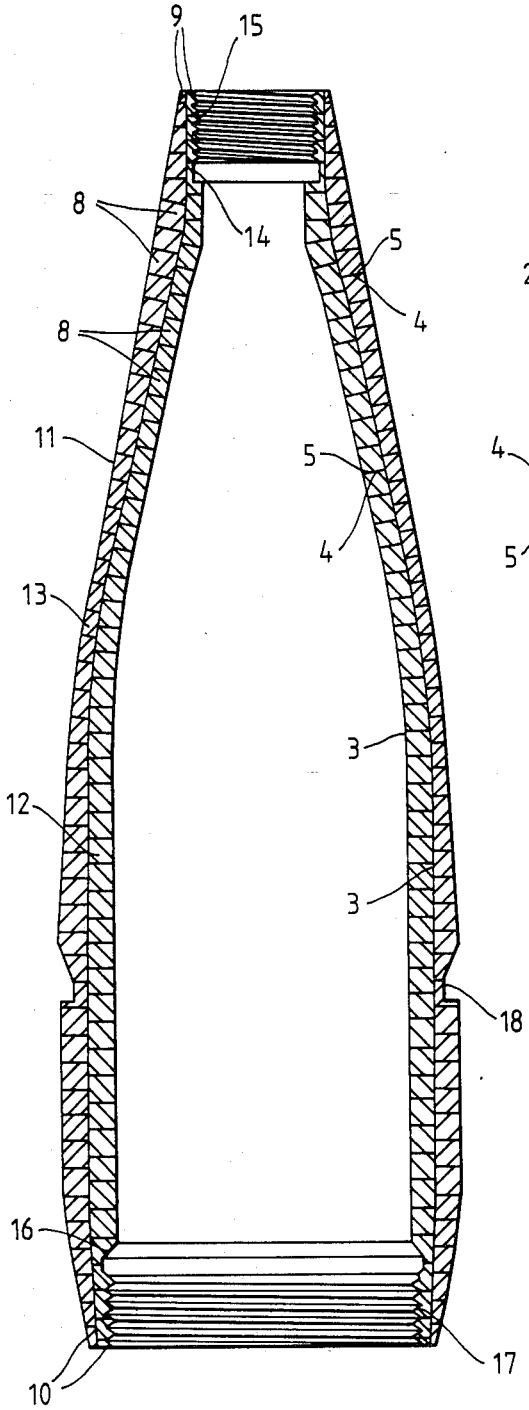
FIG. 6 is an axial section through an alternative form of mortar bomb casing in accordance with the invention.

In FIG. 6 there is shown a double coiled layer form of mortar bomb casing in accordance with the invention. As shown therein, the casing 11 comprises two coils 12, 13 each formed from notched mild steel wire stock of the kind shown in FIGS. 1 and 2. As with the casing 8, the coils 12, 13 are wound with the notched face of the wire 1 on the inner surface of the coils, although the notches 2 are not shown in FIG. 6. The two coils 12, 13 are each wound such that the flat faces 4, 5 of each turn lay substantially normal to the surface of their respective coil. The outer coil 13 is wound so that its inner surface conforms closely to the outer surface of the inner coil 12.

The surfaces of the coils 12, 13 are copper-plated and the two coils are assembled one within the other as shown in FIG. 6, with the turns 8 of the inner coil 12 overlapping longitudinally with the turns 8 of the outer coil 13 by half the width of the wire to provide greater strength in the finished double coil. In this position the copper coating is fused by brazing to bond together adjacent turns 8 of each individual coil along their adjacent faces 4, 5 and also to bond the outer face of coil 12 to the inner face of coil 13.

The ends 9, 10 or each coil 12, 13 are then machined flat. At the end 9 a recess 14 is formed in the inner coil 12, having an internal screw threaded portion 15 for the attachment of a tail cap and fins for stabilization (not shown). At the end 10 a recess16 is formed in the inner coil 12, having an internal screw threaded portion 17 for the attachment of a nose cap and fuzing unit (not shown). The exterior surface of the coil 13 is machined to a desired shape, including the provision of a groove 18 for a driving band (not shown).

The double coil construction of the casing 11 makes for greater strength than the single coil construction of the casing 7, and still allows for the production of small and optimum sized metal fragments on detonation. Conveniently a triple coil type of construction for the casing can be employed when required.

Figure 7:
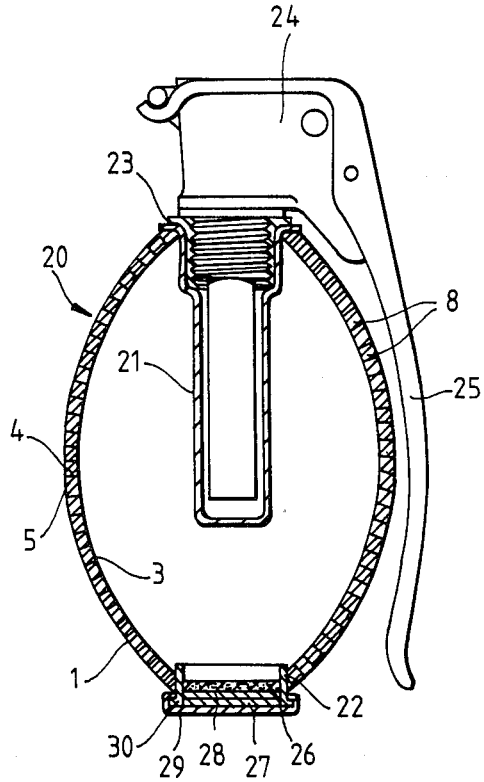
FIG. 7 is an axial section through a hand grenade having a casing in accordance with the invention.

In FIG. 7 there is shown an uncharged hand grenade 20 having a casing 21 formed of a single coil of notched wire 1 of the type shown in FIGS. 1 and 2. The coil is wound with the notches 2 (not shown) on the inner surface thereof. The casing 21 is curved in the longitudinal direction of coiling to a substantially prolate spheroidal form, by varying the diameter of turns 8 progressively along the axis of coiling. The opposed flat faces 4, 5 overlay one another completely and are at all points disposed substantially normal to the surface of the casing.

After coiling, the surface of the wire is copper-plated and the copper coating is fused by a brazing process to bond adjacent turns 8 together along their mating faces 4, 5.

The upper and lower ends of the coil are machined to receive as a press fit respectively a light pressed steel housing 21 and a light steel bush 22. Within the housing 21 there is received as a press fit an internally screw-threaded bush 23. Screwed into the bush 23 is a striker mechanism 24 (shown in outline only—not sectioned), including a handle 25 which can be released to activate the grenade.

It is intended that the casing 20, after insertion of the mechanism 24, should be inverted and filled with an explosive composition (not shown), for example a mixture of RDX and TNT, to a level just within the bush 22, but leaving space for insertion of a felt disc 26 and an end plug 27 having a square pattern of v-shaped notches 28 in its inwardly-directed surface. The casing is sealed by a pressed-steel cap 29 sealed to a flange 30 on the bush 22 in a single-roll seam. The felt disc 26 serves to prevent accidental detonation during assembly resulting from frictional contact between the notched plug 27 and the explosive material.

It will be apparent to the skilled reader that the feature of coiling so that the adjacent faces 4, 5 of the wire always lie normal to the surface of the casings 7, 11, 20 leads to certain considerable advantages as compared with conventional coiling (in which these faces remain normal to the axis of coiling).

Firstly, the mass of notched wire per unit area can remain constant over the entire surface of the coil, thus leading to a more even fragment distribution.

Secondly, the wire is capable of being formed more nearly to a spherical or spheroidal shape with smaller apertures at the ends. For example in the grenade casing 20 (FIG. 7) the apertures in which the housing 21 and the bush 22 are received are smaller than is normally possible with conventional coiling. To achieve such an angle of inclination of the surface to the longitudinal axis with conventional coiling, would require successive turns to decrease in diameter so rapidly that their faces 4, 5 would overlap one another only slightly or not at all.

Thirdly, the opposed flat faces 4, 5 can overlap substantially completely whatever the longitudinal curvature of the casing. This factor makes possible effective bonding of these faces as for example by brazing, to provide a sealed unitary structure of the required shape having considerable rigidity and strength. The need for a separate outer casing is thus avoided, with its attendant disadvantages. Also the possibility of accidental detonation as a result of explosive material being trapped between relatively movable turns, or an inner and an outer casing, is eliminated.

It should further be noted that the stepped exterior which arises with conventional cooling of a longitudinally curved casing can be avoided, hence improving the aerodynamic properties of the casing and reducing the need for costly machining.

I claim:

1. A casing for an explosive fragmentation device, said casing being formed of coiled wire, the diameter of the turns in said coiled wire being varied progressively over at least a part of the length of the casing so that in longitudinal cross-section the mean profile of the said part of the casing is inclined to the longitudinal axis thereof, the wire having a pair of opposed flat faces, the wire being twisted about its longitudinally axis during coiling so that the opposed flat faces of adjacent turns overlay one another and are oriented substantially normal to the said mean profile, and the opposed flat faces of adjacent turns being bonded together.

2. A casing as claimed in claim 1 wherein the said opposed flat faces of adjacent turns overlay one another substantially completely.

3. A grenade or mortar bomb having a casing as claimed in claim 1.

4. An explosive fragmentation device including a casing as claimed in claim 1 and a mass of explosive within the casing and in contact with the inner surface of the wire turns.

5. A casing as claimed in claim 1 wherein the wire is formed with weakened sections at intervals along its length.

6. A casing as claimed in claim 5 wherein the weakened sections are in the form of notches extending transversely of the wire across a face thereof other than the said opposed flat faces.

7. A casing as claimed in claim 6 wherein the wire is coiled with the notches on the inner surface of the coils.

8. A casing as claimed in claim 1 wherein the wire is of rectangular cross-section prior to coiling.

9. A casing as claimed in claim 1 comprising a plurality of coils arranged one to overlay the next, and the adjacent surfaces of adjacent coils conforming one to another.

10. A casing as claimed in claim 9 wherein the turns in adjacent layers overlap one another.

11. A method of making a casing for an explosive fragmentation device, including the step of coiling a length of wire into a casing having a longitudinal extent defined by superposed turns of the wire coil, said coiling step including the step of progressively varying the diameter of the turns over at least a part of the length of the casing so that in longitudinal cross-section the mean profile of the said part of the casing is inclined to the longitudinal axis thereof, the wire having a pair of opposed flat faces, said coiling step further including the step of twisting the wire about its longitudinal axis while it is being coiled, so that the opposed flat faces of adjacent turns overlay one another and are oriented substantially normal to the said mean profile, and bonding together the opposed flat faces of adjacent turns.

12. A method as claimed in claim 11 wherein the said opposed flat faces of adjacent turns are bonded together by a method selected from the group comprising soldering and brazing.

13. A method as claimed in claim 11 wherein the wire is of trapezoidal cross-section, the wire being coiled so that the face which is the narrower of the parallel faces prior to coiling is on the inner surface of the coils, and the deformation produced by the coiling action resulting in the said opposed flat faces being substantially parallel to one another after coiling.

* * * * *